US008204239B2

(12) United States Patent
Shimura et al.

(10) Patent No.: US 8,204,239 B2
(45) Date of Patent: Jun. 19, 2012

(54) AUDIO PROCESSING METHOD AND AUDIO PROCESSING APPARATUS

(75) Inventors: Masaru Shimura, Kanagawa (JP); Kazunobu Ohkuri, Kanagawa (JP); Taro Nakagami, Kanagawa (JP)

(73) Assignee: Sony Corporation, Tokyo (JP)

( * ) Notice: Subject to any disclaimer, the term of this patent is extended or adjusted under 35 U.S.C. 154(b) by 1155 days.

(21) Appl. No.: 11/977,383

(22) Filed: Oct. 24, 2007

(65) Prior Publication Data

US 2008/0103763 A1 May 1, 2008

(30) Foreign Application Priority Data

Oct. 27, 2006 (JP) ..... 2006-292104
Apr. 11, 2007 (JP) ..... 2007-103568

(51) Int. Cl.
*G10L 19/00* (2006.01)

(52) U.S. Cl. ..... 381/61; 381/56; 704/200.1

(58) Field of Classification Search ..... 381/56, 381/61; 704/200.1
See application file for complete search history.

(56) References Cited

U.S. PATENT DOCUMENTS 4,294,153 A * 10/1981 Mitsuhashi ..... 84/659
4,520,437 A * 5/1985 Boettcher et al. ..... 363/41
4,841,827 A * 6/1989 Uchiyama ..... 84/622
4,924,746 A * 5/1990 Obata ..... 84/615
5,018,427 A * 5/1991 Uchiyama ..... 84/603
5,024,134 A * 6/1991 Uchiyama ..... 84/654
5,623,219 A * 4/1997 Karraker ..... 327/50
7,342,168 B2 * 3/2008 Setoguchi ..... 84/619
7,551,742 B2 * 6/2009 Katou et al. ..... 381/61
7,907,785 B2 * 3/2011 Fukuhara et al. ..... 382/240
8,000,824 B2 * 8/2011 Shimura et al. ..... 700/94
2006/0193478 A1 * 8/2006 Setoguchi ..... 381/61
2008/0103763 A1 * 5/2008 Shimura et al. ..... 704/200.1
2011/0075851 A1 * 3/2011 LeBoeuf et al. ..... 381/56

FOREIGN PATENT DOCUMENTS

JP 04-086900 3/1992
JP 08-213862 8/1996
JP 10-049148 2/1998
JP 2004-320516 A 11/2004
JP 2004-328361 A 11/2004
JP 2005-323140 A 11/2005
JP 2008134582 A * 6/2008

* cited by examiner

*Primary Examiner* — Laura Menz
(74) *Attorney, Agent, or Firm* — Wolf, Greenfield & Sacks, P.C.

(57) ABSTRACT

Samples of a component having a frequency less than a predetermined frequency in an input audio signal that is a digital signal having a predetermined sampling frequency are written in a memory. A harmonic-overtone signal having a frequency N times a frequency of the input audio signal is generated by repeating an operation N times, where N is an integer more than one, the operation including reading one sample and thinning out (N−1) samples for every N samples from the memory within each cycle period from a first one-direction zero-crossing point to a second one-direction zero-crossing point subsequent to the first one-direction zero-crossing point, each one-direction zero-crossing point being a point at which a level of the input audio signal changes from negative to positive or a point at which the level of the input audio signal changes from positive to negative.

8 Claims, 10 Drawing Sheets

AUDIO PROCESSING METHOD AND AUDIO PROCESSING APPARATUS

CROSS REFERENCES TO RELATED APPLICATIONS

The present invention contains subject matter related to Japanese Patent Application JP 2006-292104 filed in the Japanese Patent Office on Oct. 27, 2006, and Japanese Patent Application JP 2007-103568 filed in the Japanese Patent Office on Apr. 11, 2007 the entire contents of which are incorporated herein by reference.

BACKGROUND OF THE INVENTION

1. Field of the Invention

The present invention relates to a method and apparatus for generating a harmonic overtone by multiplying a frequency of an audio signal. The present invention further relates to a method and apparatus for enhancing a low-frequency component of the audio signal using the generated harmonic overtone.

2. Description of the Related Art

In audio systems such as mini-component stereo systems and flat-screen TV receivers, small-diameter speakers are used, and enclosures (i.e., speaker boxes) accommodating speakers are also small in volume. Such speakers have a high lowest reproducible frequency f0 of about 100 Hz or more.

In general, when a low-frequency component of not greater than the lowest reproducible frequency f0 is supplied to the speakers, as the frequency decreases, the output sound pressure level of a fundamental-wave component decreases and the number of distortion components (harmonic-wave components) rapidly increases.

In audio systems including such small-diameter speakers, it is difficult to sufficiently reproduce low-frequency sounds of not greater than the lowest reproducible frequency f0 of the speakers.

Therefore, a technique based on characteristics of the human perception to generate the impression of low-frequency sounds has been conceived. For example, the sound of a musical instrument is composed of a fundamental tone and harmonic overtones thereof, and the timbre or tone color of the musical instrument is determined by the fundamental-to-overtone ratio. Psycho-acoustically, the human auditory system allows for perception of a fundamental tone being output if harmonic overtones thereof are output even though no fundamental tone is actually being output.

Japanese Unexamined Patent Application Publication No. 8-213862 discloses the use of this feature. That is, an audio signal is separated into a low-frequency component and a high-frequency component. The low-frequency component is alternately written in first and second buffers at predetermined time intervals, and is alternately read from the first and second buffers at intervals of a predetermined time by a thinning-out method. The frequency of the low-frequency component is multiplied by a factor of "a" (e.g., a factor of two). The resulting signal after the multiplication is combined with the high-frequency component using a combining unit.

The above publication only shows circuit structures and frequency characteristics but does not show a waveform chart or time chart. FIG. 11 shows a harmonic-overtone generation method of the related art based on thinning-out reading, which is disclosed in the above publication.

A low-frequency component Slin is a signal component in an audio signal, having a frequency not greater than a lowest reproducible frequency of a speaker (in the above publication, the lowest reproducible frequency is referred to as a "resonant frequency"). Although represented by an analog waveform in FIG. 11, the low-frequency component Slin is digital data including data of samples.

In the harmonic-overtone generation method of the related art disclosed in the above publication, the low-frequency component Slin is divided into segments with constant periods T10, T20, T30, etc., each corresponding to a predetermined number of samples. The samples of the low-frequency component Slin are alternately written in first and second buffers at intervals of a fixed time such that the samples corresponding to the period T10 are written in the first buffer and the samples corresponding to the period T20 are written in the second buffer.

In the read operation, the same samples are repeatedly read twice at intervals of a fixed time alternately from the first and second buffers. That is, in a first half period T21 of the period T10, the samples written in the first buffer within the period T10 are read from the first buffer in a ratio (or proportion) in which one sample is thinned out and one sample is extracted for every two samples. Also in a second half period T22 of the period T20, the samples written in the first buffer within the period T10 are read from the first buffer in a ratio in which one sample is thinned out and one sample is extracted for every two samples. In a first half period T31 of the period T30, the samples written in the second buffer within the period T20 are read from the second buffer in a ratio in which one sample is thinned out and one sample is extracted for every two samples. Also in a second half period T32 of the period T30, the samples written in the second buffer within the period T20 are read from the second buffer in a ratio in which one sample is thinned out and one sample is extracted for every two samples.

Therefore, as shown in FIG. 11, a harmonic-overtone signal Slout having a frequency twice that of the low-frequency component Slin is obtained as an output signal.

The harmonic-overtone signal Slout is combined with a high-frequency component of the input audio signal to obtain a low-frequency-enhanced output audio signal. As described above, the impression of low-frequency sounds is generated.

SUMMARY OF THE INVENTION

The harmonic-overtone generation method shown in FIG. 11 disclosed in the above publication, however, causes a problem. In this method, the samples of the low-frequency component Slin are alternately written in the first and second buffers at constant time intervals, and are alternately read from the first and second buffers at constant time intervals by a thinning-out method. Thus, as shown in FIG. 11, the level of the output harmonic-overtone signal Slout rapidly changes at boundaries, such as between the periods T21 and T22 and between periods T41 and T42, to provide a discontinuous waveform of the harmonic-overtone signal Slout, which is perceived as noise.

One method to mitigate such a rapid change in the signal level is crossfading before and after the discontinuous points. This method allows the discontinuous points to be smoothed, but inevitably involves a reduction of the sound quality.

It is therefore desirable to multiply a frequency of an audio signal such as a frequency of a low-frequency component without providing a discontinuous signal waveform.

According to an embodiment of the present invention, there is provided an audio processing method including the steps of writing, in a memory, samples of a component having a frequency less than a predetermined frequency in an input audio signal that is a digital signal having a predetermined sampling frequency; and generating a harmonic-overtone signal having a frequency N times a frequency of the input audio signal by repeating an operation N times, where N is an integer more than one, the operation including reading one sample and thinning out (N−1) samples for every N samples from the memory within each cycle period from a first one-direction zero-crossing point to a second one-direction zero-crossing point subsequent to the first one-direction zero-crossing point, each one-direction zero-crossing point being a point at which a level of the input audio signal changes from negative to positive or a point at which the level of the input audio signal changes from positive to negative.

In the audio processing method, the second one-direction zero-crossing point may not include a one-direction zero-crossing point detected before a count value obtained by counting the number of samples from the first one-direction zero-crossing point reaches a predetermined value (e.g., a predetermined value K).

In the audio processing method, when the second one-direction zero-crossing point is not detected at a time when a count value obtained by counting the number of samples from the first one-direction zero-crossing point reaches a predetermined value (e.g., a predetermined value M), the cycle period may be a period from the first one-direction zero-cross point to the time when the count value reaches the predetermined value, and the samples corresponding to the period may be read without being thinned out.

In the audio processing method, within a cycle period subsequent to the cycle period that is the period from the first one-direction zero-crossing point to the time when the count value reaches the predetermined value (e.g., the predetermined value M) when the second one-direction zero-crossing point is not detected at the time when the count value obtained by counting the number of samples from the first one-direction zero-crossing point reaches the predetermined value, samples corresponding to a period from the time when the count value reaches the predetermined value to the second one-direction zero-crossing point may be read without being thinned out.

In the audio processing method, the one-direction zero-crossing point may be a point at which the level of the input audio signal has a predetermined positive value after changing from negative to positive, or a point at which the level of the input audio signal has a predetermined negative value after changing from positive to negative.

In an embodiment of the present invention, therefore, samples are repeatedly read twice from a buffer within each cycle period from a first one-direction zero-crossing point to a second one-direction zero-crossing point subsequent to the first one-direction zero-crossing point, rather than within a constant time period corresponding to a predetermined number of samples of the input audio signal, in a ratio in which, for example, one samples are thinned out and one sample is extracted for every two samples. Therefore, an output audio signal exhibits a continuous waveform even at a boundary point at which the same samples are repeatedly read.

Further, in the embodiment of the present invention, the occurrence of harmonic waves caused by multiplying the frequency of a high-frequency component in the input audio signal can be prevented.

Further, in the embodiment of the present invention, when the second one-direction zero-crossing point is not detected at a time when a count value obtained by counting the number of samples from the first one-direction zero-crossing point reaches a predetermined value (e.g., a predetermined value M), as exceptional processing, samples corresponding to a period from the first one-direction zero-crossing point to the second one-direction zero-crossing point are read without being thinned out. Therefore, even if the time of one wave of the input audio signal is as long as a buffer length or longer than the buffer length, the waveform of an output audio signal is not discontinuous.

According to an embodiment of the present invention, therefore, a frequency of an audio signal such as a frequency of a frequency of a low-frequency component can be multiplied without causing a problem of a discontinuous signal waveform.

DESCRIPTION OF THE PREFERRED EMBODIMENTS

A basic method for low-frequency enhancement based on harmonic-overtone generation and an audio processing apparatus will be described with reference to FIGS. 1 to 4.

First, a basic method for low-frequency enhancement based on harmonic-overtone generation will be described with reference to FIG. 1.

Figure 1:
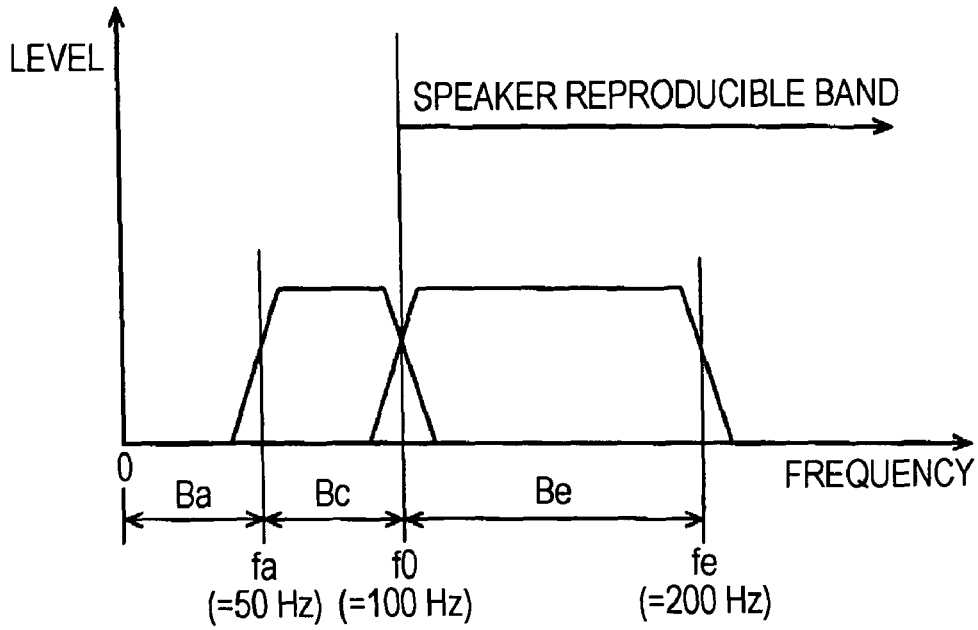
FIG. 1 is a diagram showing a frequency characteristic of a speaker.

FIG. 1 shows a frequency characteristic of a small-diameter speaker.

The speaker has a high lowest reproducible frequency f0 of, for example, 100 Hz. In a frequency range not greater than the lowest reproducible frequency f0, the lower the frequency, the lower the output sound pressure level of a fundamental-wave component.

A band Be from the lowest reproducible frequency f0 to a frequency fe (=2f0) is the region corresponding to the lowest-frequency sounds audible to the human ear. In general, the generation of harmonic-overtone signals having a frequency not greater than about 200 Hz would not make listeners uncomfortable.

In an embodiment of the present invention, therefore, a low-frequency component of not greater than, for example, the lowest reproducible frequency f0 is multiplied by a factor of 2 using a method described below to generate a second-harmonic-overtone signal, and the harmonic-overtone signal is combined with a signal component of not less than the lowest reproducible frequency f0 in the input audio signal to obtain a low-frequency-enhanced output audio signal.

In this case, by multiplying a low-frequency component ranging from 0 Hz to 100 Hz (the lowest reproducible frequency f0) by a factor of 2, a harmonic-overtone signal ranging from 0 Hz to 200 Hz (the frequency fe) is obtained.

However, the multiplication of a low-frequency component having a band Ba from 0 Hz to 50 Hz (a frequency fa (=f0/2)) by a factor of 2 would not lead to low-frequency enhancement because the resulting low-frequency component does not reach the band Be.

Therefore, the low-frequency component having the band Ba may not be subjected to harmonic-overtone generation, and only a low-frequency component having a band Bc from the frequency fa to the lowest reproducible frequency f0 may be subjected to harmonic-overtone generation.

An audio processing apparatus for use in harmonic-overtone generation and zero-crossing points will be described with reference to FIGS. 2 and 3.

Figure 2:
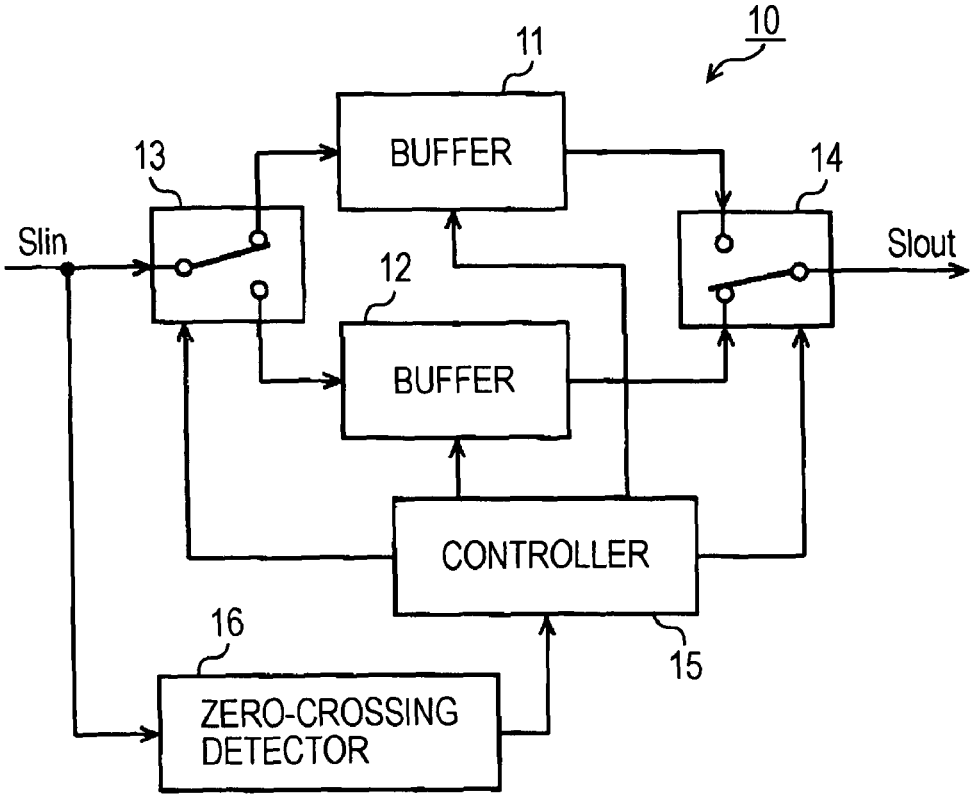
FIG. 2 is a diagram showing an example of an audio processing apparatus for use in harmonic-overtone generation.

FIG. 2 shows an example of an audio processing apparatus configured to perform the harmonic-overtone generation method according to the embodiment of the present invention.

In the example shown in FIG. 2, a harmonic-overtone generation processing unit 10 is implemented as, for example, a digital signal processor (DSP).

A low-frequency component Slin is a signal component in an input audio signal, having a frequency not greater than the lowest reproducible frequency f0 of the speaker. The low-frequency component Slin is digital audio data and is composed of data of samples, as indicated by thick vertical lines shown in the upper part of FIG. 3. If the sampling frequency is represented by fs, a sample period is given by 1/fs.

In the harmonic-overtone generation processing unit 10, the low-frequency component Slin is alternately distributed to buffers 11 and 12 by means of a switch 13, and is alternately written in the buffers 11 and 12 under the control of a controller 15. Then, the low-frequency component Slin is alternately read from the buffers 11 and 12 by a thinning-out method, described below, under the control of the controller 15, and is extracted as a harmonic-overtone signal Slout by means of a switch 14.

The cycle time of writing the samples of the low-frequency component Slin in the buffers 11 and 12, and the cycle time of reading the samples of the low-frequency component Slin from the buffers 11 and 12 are not constant but changes according to the frequency of the low-frequency component Slin by detecting zero-crossing points of the low-frequency component Slin by a zero-crossing detector 16.

Figure 3:
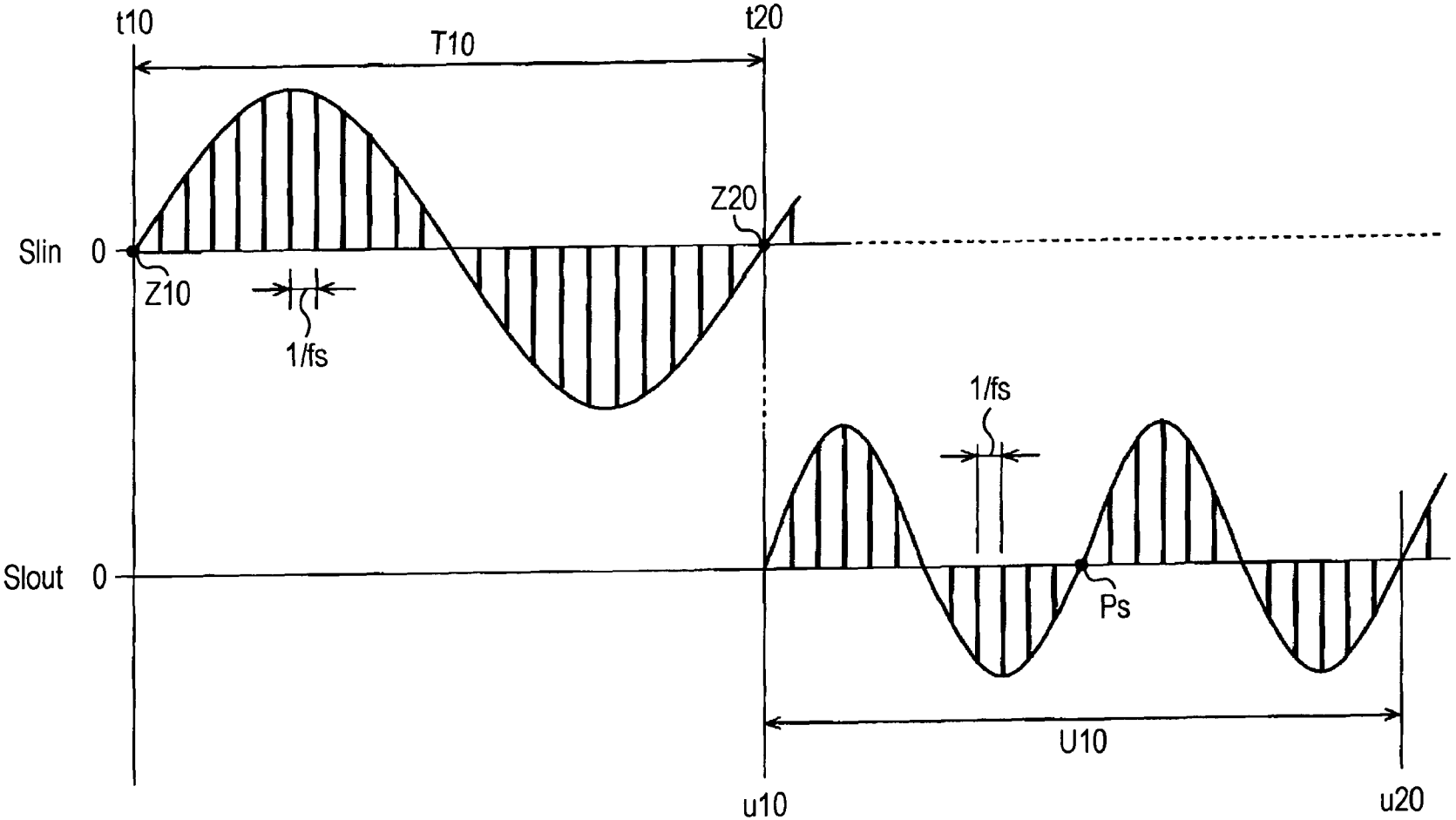
FIG. 3 is a diagram showing a harmonic-overtone generation method according to an embodiment of the present invention.

As can be seen from the upper part of FIG. 3, the zero-crossing points of the low-frequency component Slin include a positive-going zero-crossing point (a point at which the low-frequency component Slin changes from negative to positive) and a negative-going zero-crossing point (a point at which the low-frequency component Slin changes from positive to negative). In the embodiment of the present invention, either zero-crossing point, e.g., the positive-going zero-crossing point, is used as a reference one-direction zero-crossing point to determine a cycle time.

As described below, a dead zone may be provided for zero-crossing detection, and a positive-going predetermined-value-crossing point (a point at which the low-frequency component Slin has a predetermined positive value after changing from negative to positive) or a negative-going predetermined-value-crossing point (a point at which the low-frequency component Slin has a predetermined negative value after changing from positive to negative), e.g., the positive-going predetermined-value-crossing point, may be used as a reference one-direction zero-crossing point to determine a cycle time.

In the following description, a positive-going zero-crossing point or a positive-going predetermined-value-crossing point is used as a one-direction zero-crossing point by way of example, and the one-direction zero-crossing point is hereinafter referred to simply as a "zero-crossing point" unless otherwise expressly defined.

In the example shown in FIG. 3, a one-wave period T10 between zero-crossing points Z10 and Z20 of the low-frequency component Slin, i.e., from a time t10 and a time t20, is the first write cycle period during which samples of the low-frequency component Slin are written in one buffer.

A period U10 subsequent to the period T10, having the same time length as that of the period T10, from a time u10 to a time u20 is the first read cycle period during which the written samples are repeatedly read twice from the one buffer in a ratio in which one sample is thinned out and one sample is extracted for every two samples.

Consequently, as shown in the lower portion of FIG. 3, a harmonic-overtone signal Slout having a frequency twice that of the low-frequency component Slin is obtained as an output signal. The harmonic-overtone signal Slout exhibits a continuous waveform even at a boundary point Ps at which the same samples of the harmonic-overtone signal Slout are repeatedly read and at which the same waveform is repeated.

The structure shown FIG. 2 includes two buffers, namely, the buffers 11 and 12, by way of example. Alternatively, a single ring buffer may be used, and write addresses and read addresses of the ring buffer may be sequentially changed so that samples can be sequentially written and sequentially read.

Figure 4:
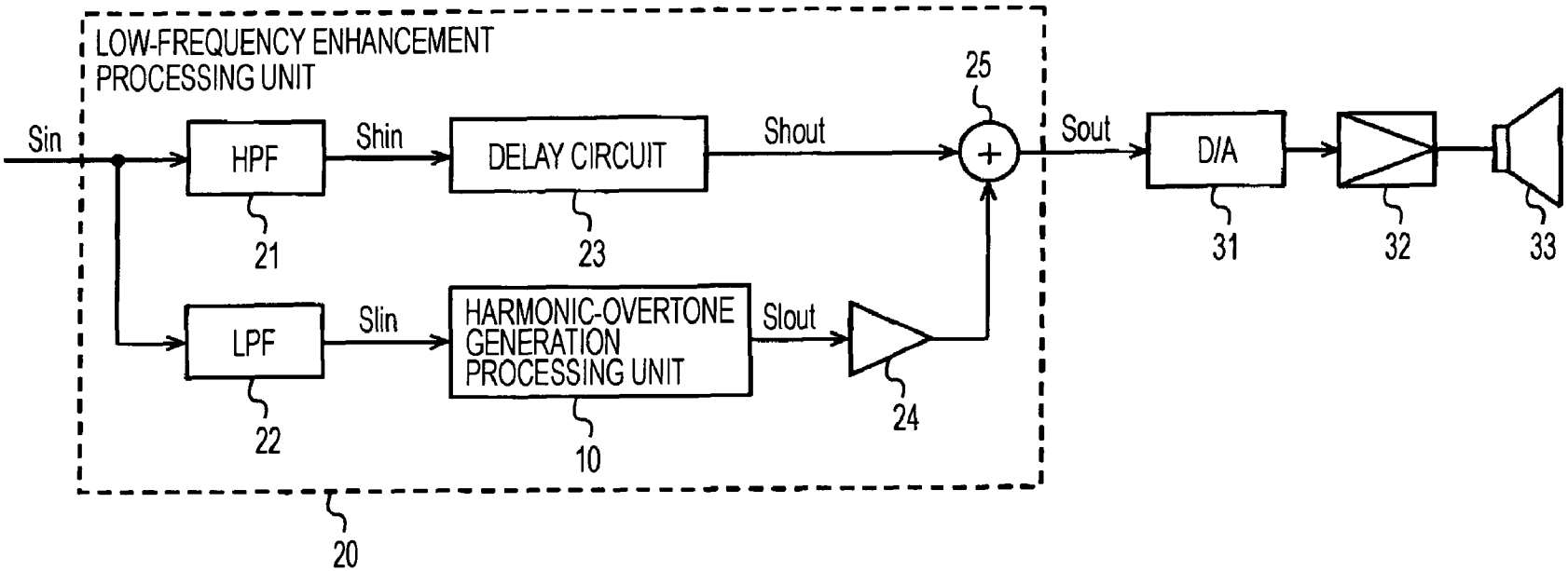
FIG. 4 is a diagram showing an example of an audio processing apparatus for use in low-frequency enhancement.

FIG. 4 shows an example of an audio processing apparatus configured to perform a low-frequency enhancement method according to an embodiment of the present invention.

In the example shown in FIG. 4, a low-frequency enhancement processing unit 20 can be implemented as a DSP. A speaker 33 is a small-diameter speaker with a lowest reproducible frequency f0 of, for example, 100 Hz, as described above. An input audio signal Sin is digital audio data having the sampling frequency fs described above.

The input audio signal Sin is separated into a signal component Shin having a frequency not less than the lowest reproducible frequency f0 of the speaker 33 and a low-frequency component Slin having a frequency not greater than the lowest reproducible frequency f0 by a high-pass filter 21 and a low-pass filter 22 of the low-frequency enhancement processing unit 20.

The frequency of the low-frequency component Slin is multiplied using the harmonic-overtone generation processing unit 10 shown in FIG. 2 in the manner described above, and is converted into the harmonic-overtone signal Slout described above. A multiplication circuit 24 multiplies the harmonic-overtone signal Slout by a certain factor.

The signal component Shin is delayed by a delay circuit 23 so as to match the time delay in the harmonic-overtone generation processing unit 10.

The delayed signal component Shout and the harmonic-overtone signal Slout multiplied by the factor are added by an adder circuit 25, and a low-frequency-enhanced output audio signal Sout is obtained.

The output audio signal Sout is converted into an analog audio signal by a digital-to-analog (D/A) converter 31, and the analog audio signal is amplified by an audio amplifier circuit 32 before being supplied to the speaker 33.

Therefore, as described above, audio reproduction with sufficient impression of low-frequency sounds is achieved, and audio reproduction without degradation in the sound quality caused by a discontinuous signal waveform is also achieved.

Examples of the harmonic-overtone generation method will be described with reference to FIGS. 5 to 10.

Figure 5:
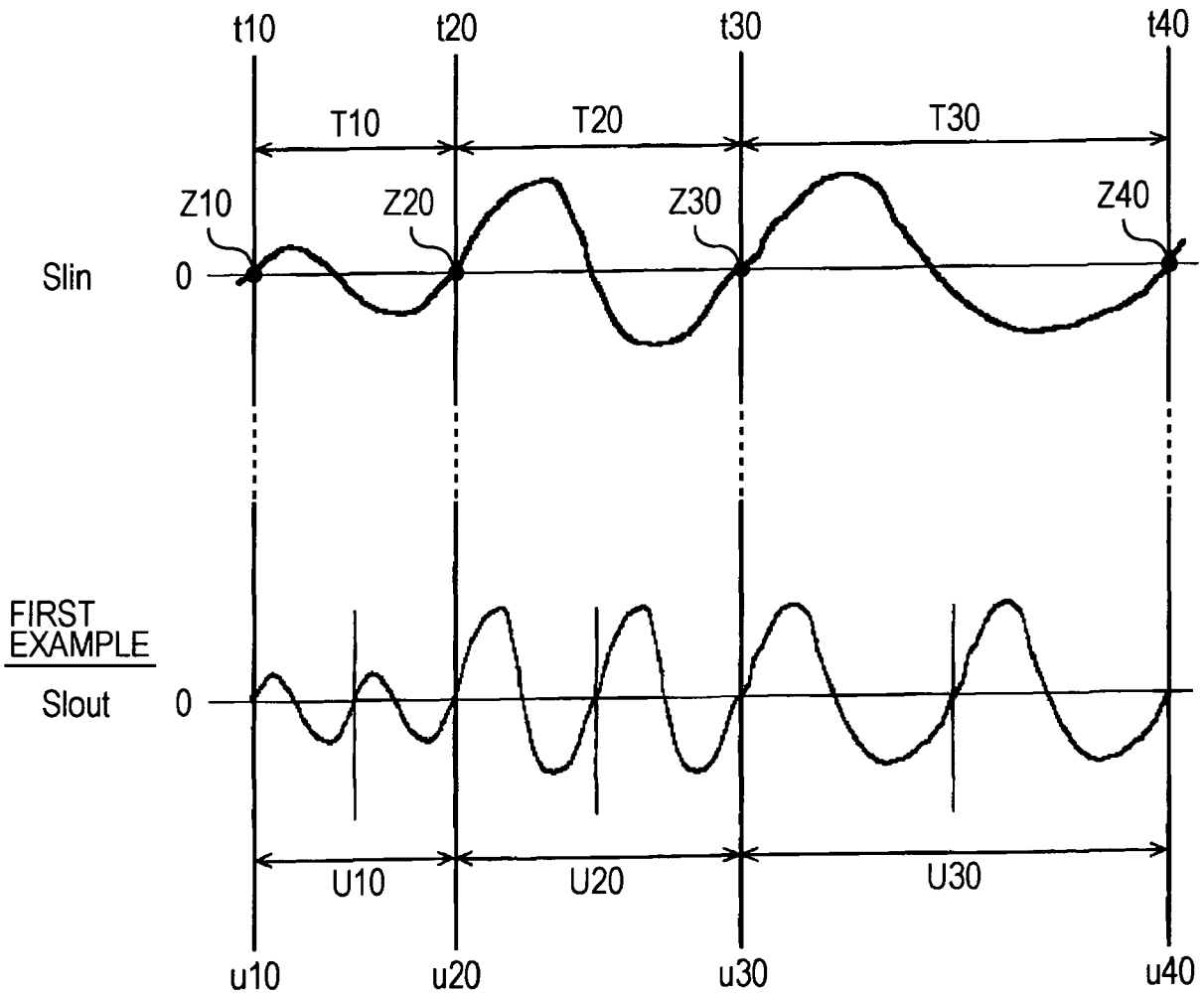
FIG. 5 is a diagram showing a first example of the harmonic-overtone generation method according to the embodiment of the present invention.

FIG. 5 shows a basic example (first example) of the harmonic-overtone generation method according to the embodiment of the present invention.

In the example shown in FIG. 5, a period of one wave from a zero-crossing point of the low-frequency component Slin to a zero-crossing point subsequent thereto is one cycle period during which samples are written in a buffer and read from the buffer by a thinning-out method.

Specifically, in the first half period of a period U10 from a time u10 to a time u20, samples corresponding to a period T10 between zero-crossing points Z10 and Z20 of the low-frequency component Slin (from a time t10 to a time t20) are thinned out at a thinning ratio of 1/2 and are read. Also in the second half period of the period U10, the same samples are thinned out at a thinning ratio of /1;2 and are read.

Similarly, in the first and second half periods of a period U20 from the time u20 to a time u30, samples corresponding to a period T20 between zero-crossing points Z20 and Z30 of the low-frequency component Slin (from the time t20 to a time t30) are thinned out at a thinning ratio of 1/2 and are read repeatedly twice. In the first and second half periods of a period U30 from the time u30 to a time u40, sample corresponding to a period T30 between zero-crossing points Z30 and Z40 of the low-frequency component Slin (from the time t30 to a time t40) are thinned out at a thinning ratio of 1/2 and are read repeatedly twice.

Therefore, as shown in FIG. 5, the harmonic-overtone signal Slout exhibits a continuous waveform even at boundary points at which the same samples are repeatedly read and at which the same waveform is repeated.

Figure 6:
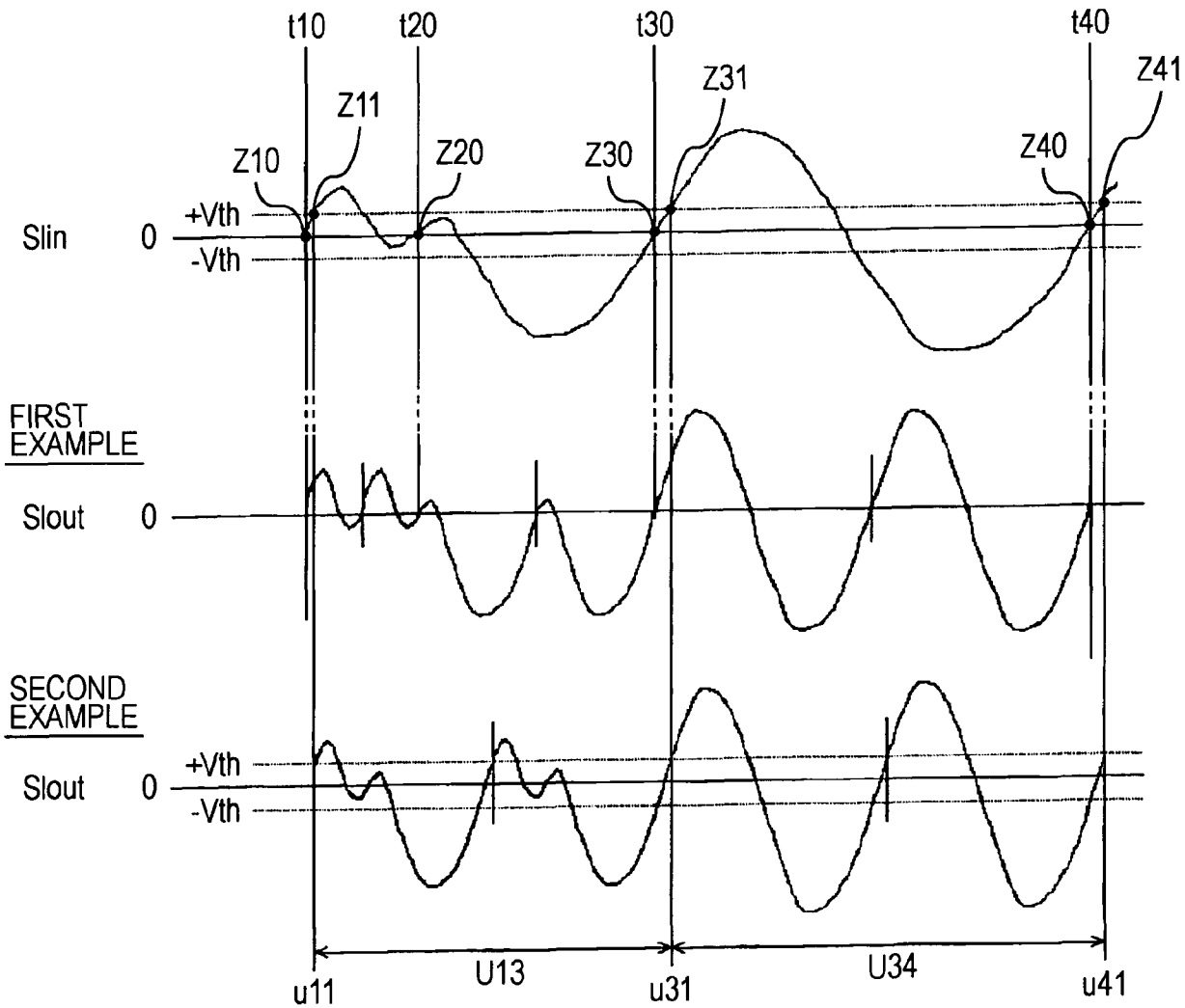
FIG. 6 is a diagram showing a second example of the harmonic-overtone generation method according to the embodiment of the present invention.

FIG. 6 shows a second example of the harmonic-overtone generation method according to the embodiment of the present invention.

In the second example, as shown in the upper part of FIG. 6, a point at which the low-frequency component Slin has a predetermined positive value +Vth after changing from negative to positive, i.e., the positive-going predetermined-value-crossing point described above, or a point at which the low-frequency component Slin has a predetermined negative value −Vth after changing from positive to negative, i.e., the negative-going predetermined-value-crossing point described above, e.g., the positive-going predetermined-value-crossing point, is set as a zero-crossing point (one-direction zero-crossing point) to determine one cycle period.

If the low-frequency component Slin has a waveform shown in the upper part of FIG. 6, in the first example described above, points Z10, Z20, Z30, Z40, etc., are zero-crossing points, and the harmonic-overtone signal Slout exhibits a waveform shown in the middle part of FIG. 6. In the second example, on the other hand, points Z11, Z31, Z41, etc., are zero-crossing points, and the period between the points Z11 and Z31 is regarded as a period of one wave although it is a period of two waves. As shown in the lower part of FIG. 6, in the first half period of a period U13 from a time u11 to a time u31, samples corresponding to the period between the zero-crossing points Z11 and Z31 of the low-frequency component Slin are thinned out at a thinning ratio of 1/2 and are read, and in the second half period of the period U13, the same samples are thinned out at the same thinning ratio and are read. Similarly, in the first and second half periods of a period U34 from the time u31 to a time u41, samples corresponding to the period between the zero-crossing points Z31 and Z41 of the low-frequency component Slin are thinned out at a thinning ratio of 1/2 and are read repeatedly twice.

Also in the second example shown in FIG. 6, therefore, the harmonic-overtone signal Slout exhibits a continuous waveform. In the second example, furthermore, a low-pass filtering effect in which an unwanted harmonic-wave component having a level lower than the fundamental-wave component is ignored in zero-crossing detection is achieved.

Figure 7:
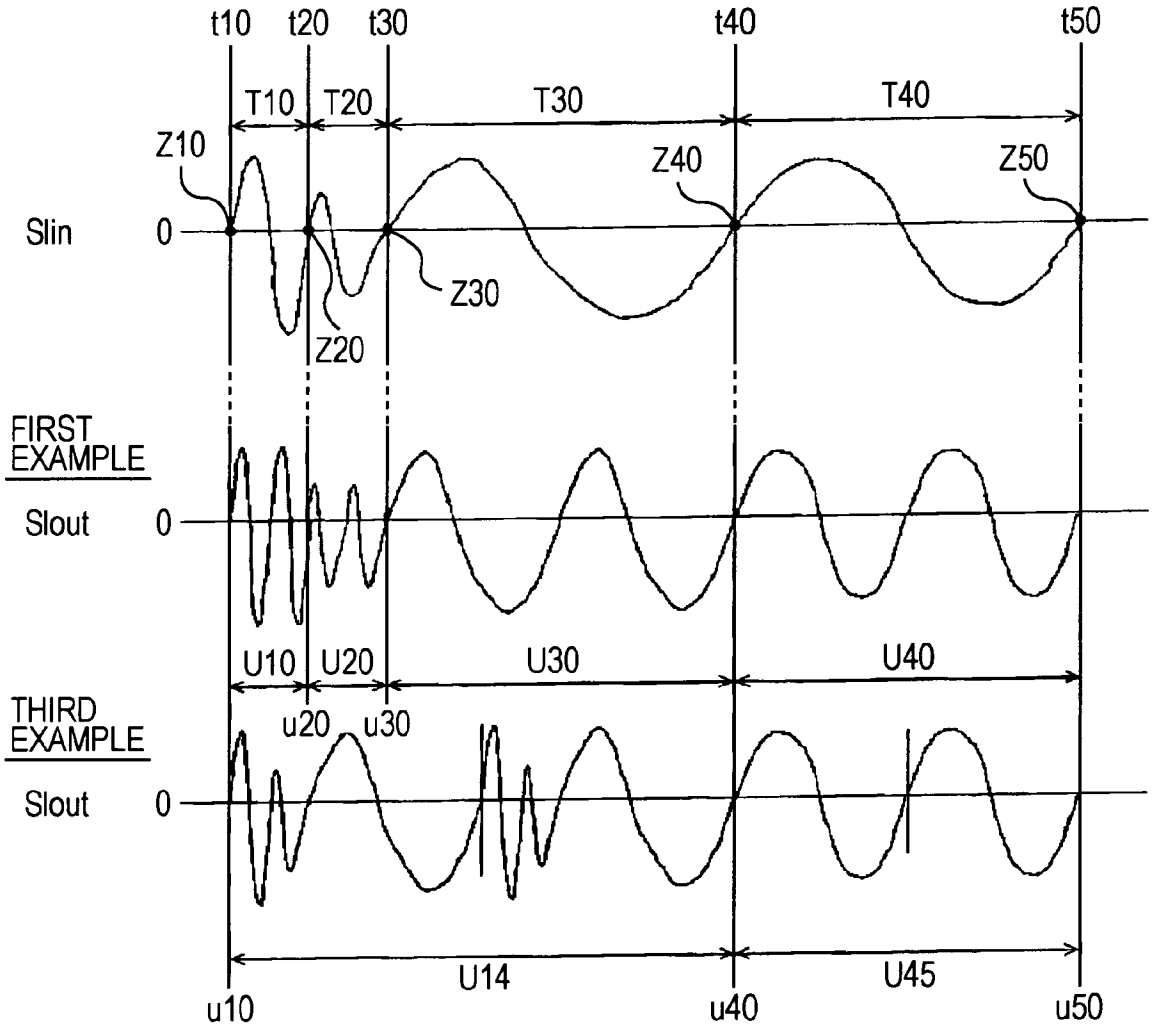
FIG. 7 is a diagram showing a third example of the harmonic-overtone generation method according to the embodiment of the present invention.

FIG. 7 shows a third example of the harmonic-overtone generation method according to the embodiment of the present invention.

In the third example, the number of samples from a zero-crossing point that is the start point of a given cycle period is counted, and a zero-crossing point detected before the count value reaches a predetermined value K is not set as a zero-crossing point that is the end point of the cycle period (i.e., the start point of the next cycle period) so that one cycle period is set equal to or more than the predetermined value K in terms of the number of samples.

Specifically, if the low-frequency component Slin has a waveform shown in the upper part of FIG. 7, in the first example described above, points Z10, Z20, Z30, Z40, Z50, etc., are zero-crossing points, and samples of the low-frequency component Slin are written and read in the manner described above. As a result, the harmonic-overtone signal Slout exhibits a waveform shown in the middle part of FIG. 7.

In the third example, on the other hand, the points Z20 and Z30 are ignored and the points Z10, Z40, and Z50 are set as zero-crossing points because the points Z20 and Z30 are detected before a count value j obtained by counting the number of samples from the point Z10 reaches the predetermined value K while the point Z40 is detected after the count value j obtained by counting the number of samples from the point Z10 reaches the predetermined value K and the point Z50 is also detected after the count value j obtained by counting the number of samples from the point Z40 reaches the predetermined value K. Each of the period between the zero-crossing points Z10 and Z40, and the period between the zero-crossing points Z40 and Z50 is regarded as one cycle period.

In the read operation, as shown in the lower part of FIG. 7, in the first half period of a period U14 from a time u10 to a time u40, samples corresponding to the period between the zero-crossing points Z10 and Z40 of the low-frequency component Slin are thinned out at a thinning ratio of 1/2 and are read, and in the second half period of the period U14, the same samples are thinned out at the same thinning ratio and are read. In the first half period of a period U45 from the time u40 to a time u50, samples corresponding to the period between the zero-crossing points Z40 and Z50 of the low-frequency component Slin are thinned out at a thinning ratio of 1/2 and are read, and in the second half period of the period U45, the same samples are thinned out at the same thinning ratio and are read.

In the third example, therefore, the harmonic-overtone signal Slout exhibits a continuous waveform, and the occurrence of harmonic waves caused by multiplying the frequency of a high-frequency component in the low-frequency component Slin can be prevented.

Also in the third example, the positive-going predetermined-value-crossing point or negative-going predetermined-value-crossing point described above may be used as a zero-crossing point. In this case, the third example is used in combination with the second example described above.

A fourth example of the harmonic-overtone generation method according to the embodiment of the present invention will be described with reference to FIGS. 8 to 10.

Figure 8:
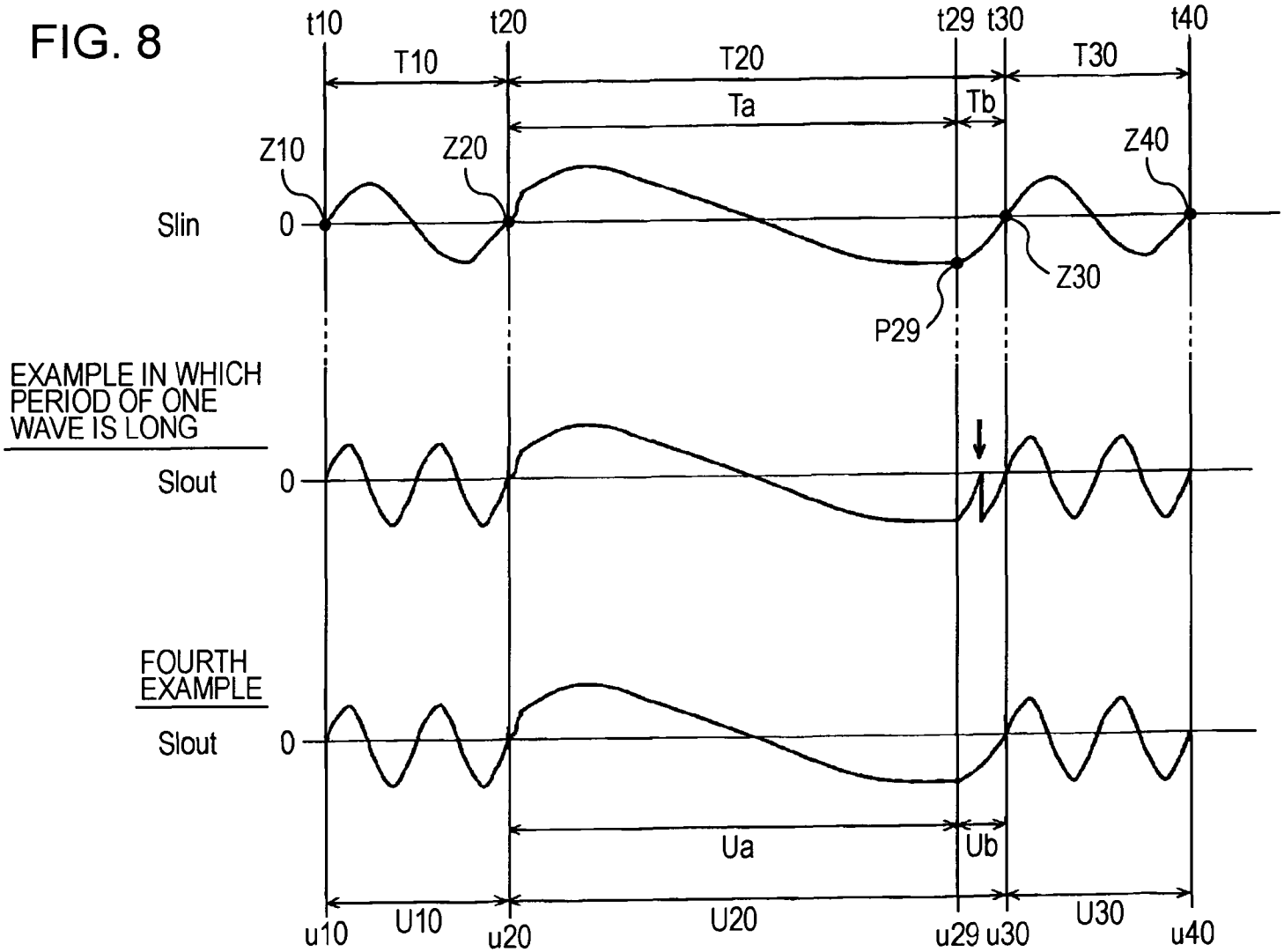
FIG. 8 is a diagram showing a situation in a fourth example of the harmonic-overtone generation method according to the embodiment of the present invention.

Although not shown in FIGS. 5 to 7, as indicated in a period T20 from a time t20 to a time t30 (between zero-crossing points Z20 and Z30) shown in FIG. 8, in some cases, the frequency of the low-frequency component Slin may be considerably low, that is, the period of one wave of the low-frequency component Slin may be considerably long. In such cases, it may be difficult to write samples corresponding to the period of one wave in a buffer depending on the length of the buffer.

To avoid such inconvenience, if the time (wavelength) from a given zero-crossing point of the low-frequency component Slin to a zero-crossing point subsequent thereto exceeds a value M that is close to a buffer length L in terms of the number of samples, that is, if the subsequent zero-crossing point is not detected even after M samples of the low-frequency component Slin have been counted from the given zero-crossing point was detected, each of a less-than-one-wave period from the time at which the given zero-crossing point was detected to the time at which the count value j of the number of samples reaches the value M, and a less-than-one-wave period from the time at which the count value j of the number of samples reaches the value M to the time at which the subsequent zero-crossing point is detected is regarded as a period of one wave and is set as a cycle period.

Specifically, it is assumed that the low-frequency component Slin has a waveform shown in the upper part of FIG. 8. If a time t29 is a time at which M samples have been counted from the time t20, a less-than one-wave period Ta from the time t20 to the time t29 (between the zero-crossing point Z20 and a non-zero-crossing point P29) is regarded as a period of one wave and is set as a cycle period subsequent to a one-wave period T10 from a time t10 to the time t20 (between zero-crossing points Z10 and Z20). A less-than-one-wave period Tb from the time t29 to the time t30 (between the non-zero-crossing point P29 and the zero-crossing point Z30) is also regarded as a period of one wave and is set as a cycle period subsequent to the period Ta.

The cycle pattern over the periods T10 and T30 is a regular pattern. The cycle pattern over the period Ta is a front-side irregular pattern and the cycle pattern over the period Tb is a rear-side irregular pattern.

In the read operation, for example, the following method is conceivable. As indicated in the middle part of FIG. 8, in a period U10 from a time u10 to a time u20 corresponding to the period T10 from the time t10 to the time t20, according to principle, samples corresponding to the period T10 of the low-frequency component Slin are thinned out at a thinning ratio of 1/2 and are read repeatedly twice. In a period Ua from the time u20 to a time u29 corresponding to the period Ta from the time t20 to the time t29, as an exception, samples corresponding to the period Ta of the low-frequency component Slin are read once without being thinned out. In a period Ub from the time u29 to a time u30 corresponding to the period Tb from the time t29 to the time t30, according to principle, samples corresponding to the period Tb of the low-frequency component Slin are thinned out at a thinning ratio of 1/2 and are read repeatedly twice. Also in a period U30 from the time u30 to a time u40 corresponding to the period T30 from the time t30 to the time t40, as an principle, samples corresponding to the period T30 of the low-frequency component Slin are thinned out at a thinning ratio of 1/2 and are read repeatedly twice.

In this method, however, as indicated by a downward arrow shown in FIG. 8, a discontinuous waveform of the output harmonic-overtone signal Slout (in this case, a portion of the output harmonic-overtone signal Slout is exceptionally maintained as the fundamental tone but not as a harmonic overtone) is provided at an intermediate point of the period Ub.

In the fourth example, therefore, as shown in the lower part of FIG. 8, in the period Ua corresponding to the period Ta, as described above, the samples corresponding to the period Ta of the low-frequency component Slin are read once without being thinned out, and also in the period Ub corresponding to the period Tb, the samples corresponding to the period Tb of the low-frequency component Slin are read once without being thinned out. Thus, in the fourth example, the output harmonic-overtone signal Slout exhibits a completely continuous waveform.

In the fourth example, one wave over the periods Ua and Ub of the harmonic-overtone signal Slout is the fundamental tone rather than a second-harmonic overtone. However, the frequency of this wave is too low to reach the band Be shown in FIG. 1 even if the frequency is multiplied by a factor of 2, which does not affect auditory perception.

For example, it is assumed that the sampling frequency fs is 44.1 kHz, the buffer length L is equal to 4096 samples, and the value M is equal to 3584 samples, which is ⅞ of the buffer length L. In this case, the frequency of the wave over the periods Ua and Ub of the harmonic-overtone signal Slout is not higher than 12.3 Hz because the wavelength is not less than 81 msec (=3584/fs).

Furthermore, in some cases, the low-frequency component Slin may have a lower frequency, or may have only a direct-current component.

Figure 9:
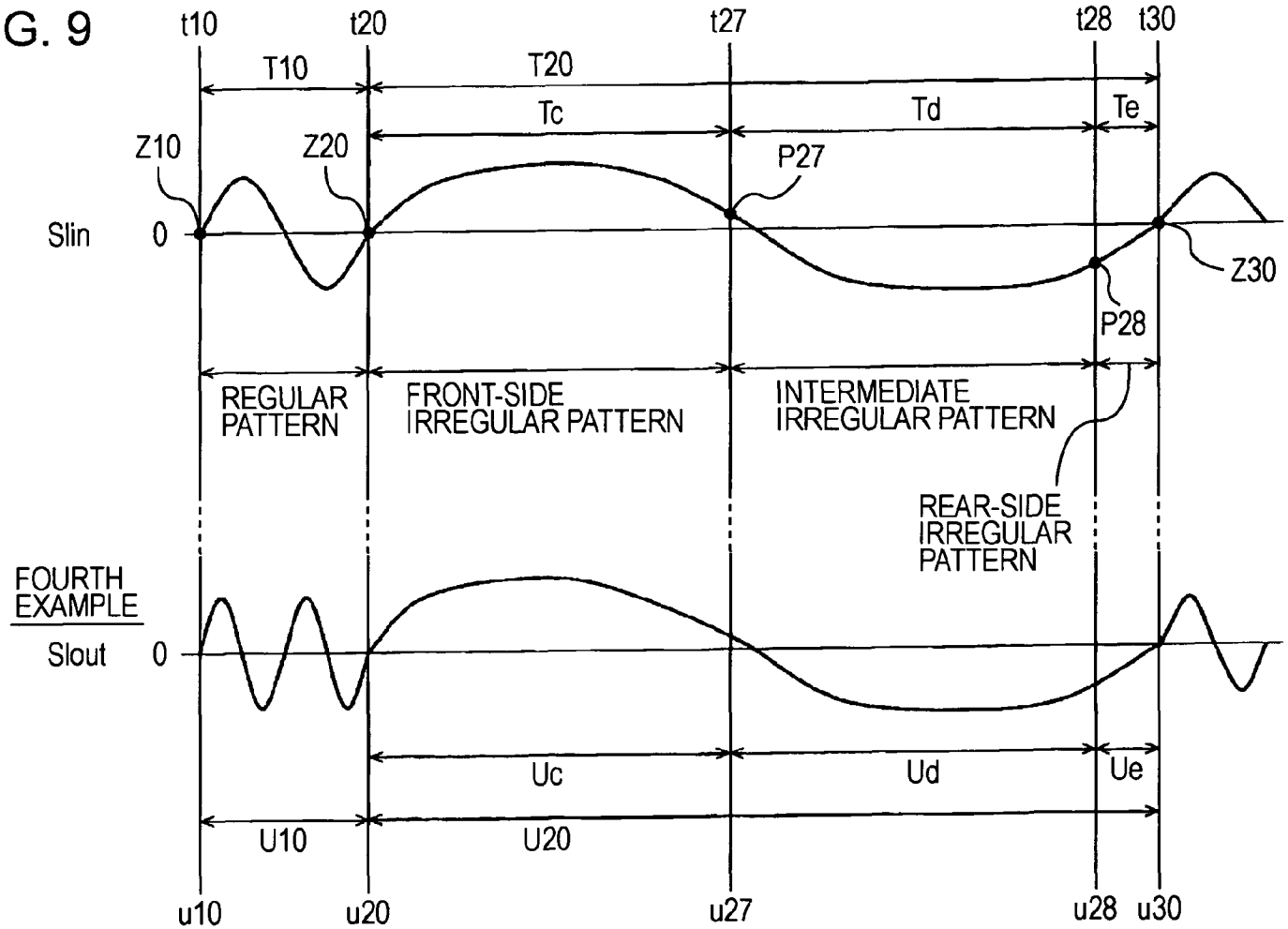
FIG. 9 is a diagram showing another situation in the fourth example of the harmonic-overtone generation method according to the embodiment of the present invention.

Specifically, FIG. 9 shows a situation where the period T20 between the zero-crossing points Z20 and Z30 (from the time t20 to the time t30) of the low-frequency component Slin is longer than that shown in FIG. 8. In this situation, the zero-crossing point Z30 subsequent to the zero-crossing point Z20 does not appear even at a time t27 at which M samples have been counted from the time t20, and the zero-crossing point Z30 subsequent to the zero-crossing point Z20 does not appear even at a time t28 at which M samples have been counted from the time t27. The zero-crossing point Z30 subsequent to the zero-crossing point Z20 appears at the time t30 at which m samples ($m \leqq M$) have been counted from the time t28.

In this situation, in the write operation to a buffer, after samples corresponding to a one-wave period T10 from a time t10 to a time t20 (between zero-crossing points Z10 and Z20) are written in one buffer (e.g., the buffer 11 shown in FIG. 2), samples corresponding to a less-than-one-wave period Tc from the time t20 to the time t27 (between the zero-crossing point Z20 and a non-zero-crossing point P27) are written in the other buffer (e.g., the buffer 12 shown in FIG. 2). Further, samples corresponding to a period Td less than a period of one wave between the times t27 and t28 (between the non-zero-crossing points P27 and P28) are written in the one buffer (e.g., the buffer 11 shown in FIG. 2), and samples corresponding to a less-than-one-wave period Te from the time t28 to the time t30 (between the non-zero-crossing point P28 and the zero-crossing point Z30) are written in the other buffer (e.g., the buffer 12 shown in FIG. 2).

The cycle pattern over the period T10 is a regular pattern, and the cycle pattern over the period Tc is a front-side irregular pattern. The cycle pattern over the period Td is an intermediate irregular pattern, and the cycle pattern over the period Te is a rear-side irregular pattern.

In the read operation, as shown in the lower part of FIG. 9, in a period U10 from a time u10 to a time u20 corresponding to the period T10 from the time t10 to the time t20, according to principle, the samples corresponding to the period T10 of the low-frequency component Slin are thinned out at a thinning ratio of 1/2 and are read repeatedly twice. In a period Uc from the time u20 to a time u27 corresponding to the period Tc from the time t20 to the time t27, a period Ud from the time u27 to a time u28 corresponding to the period Td from the time t27 to the time t28, and a period Ue from the time u28 to a time u30 corresponding to the period Te from the time t28 to the time t30, as exceptions, the samples corresponding to the periods Tc, Td, and Te of the low-frequency component Slin are read once without being thinned out, respectively.

In FIG. 9, only one intermediate irregular pattern exists over the period Td provided between the period Tc over which the front-side irregular pattern is exhibited and the period Te over which the rear-side irregular pattern is exhibited. If the low-frequency component Slin has a lower frequency, a plurality of intermediate irregular patterns continuously exist.

Figure 10:
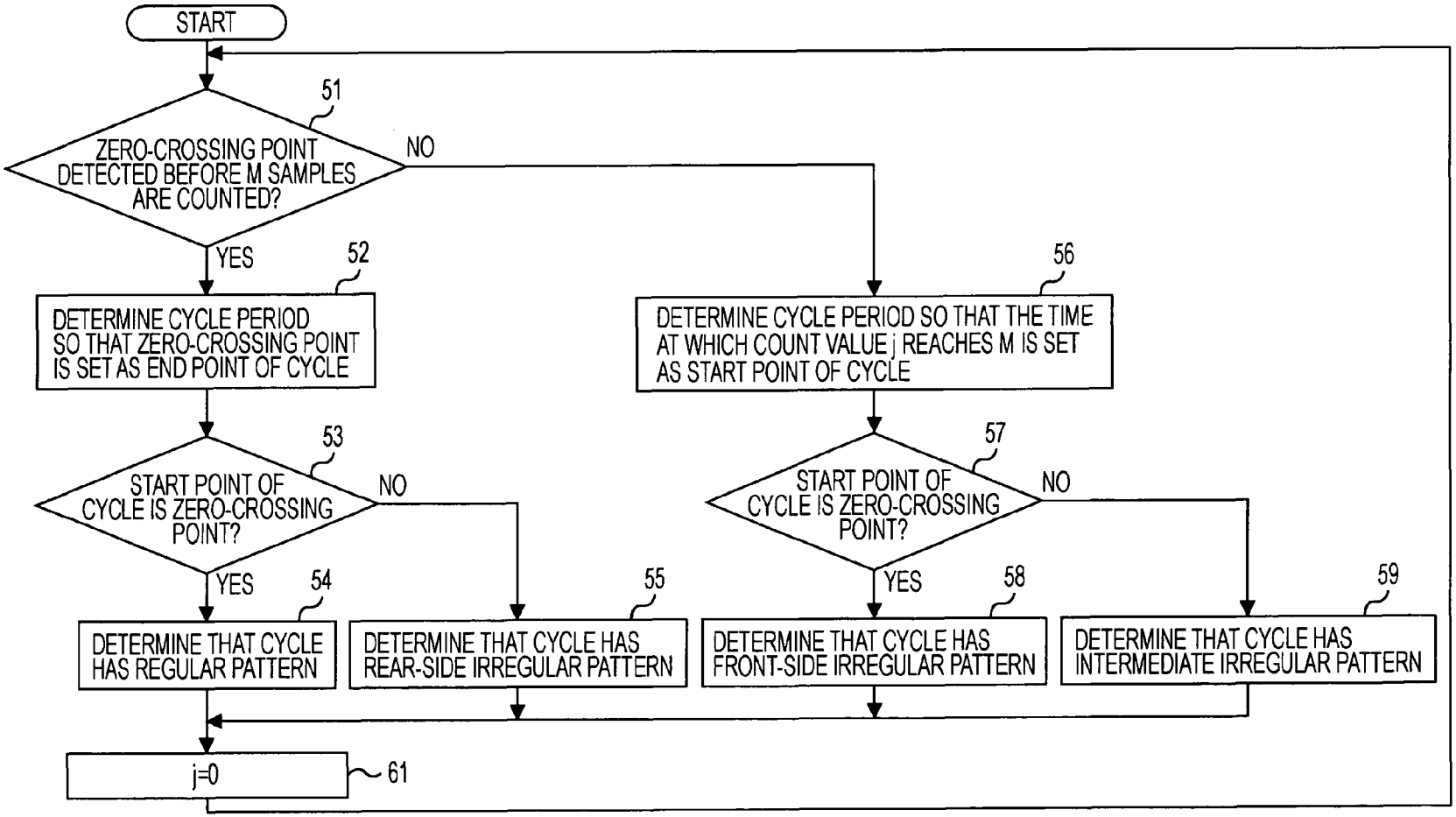
FIG. 10 is a flowchart showing a process for determining a cycle period and a cycle pattern in the fourth example of the harmonic-overtone generation method.
Figure 11:
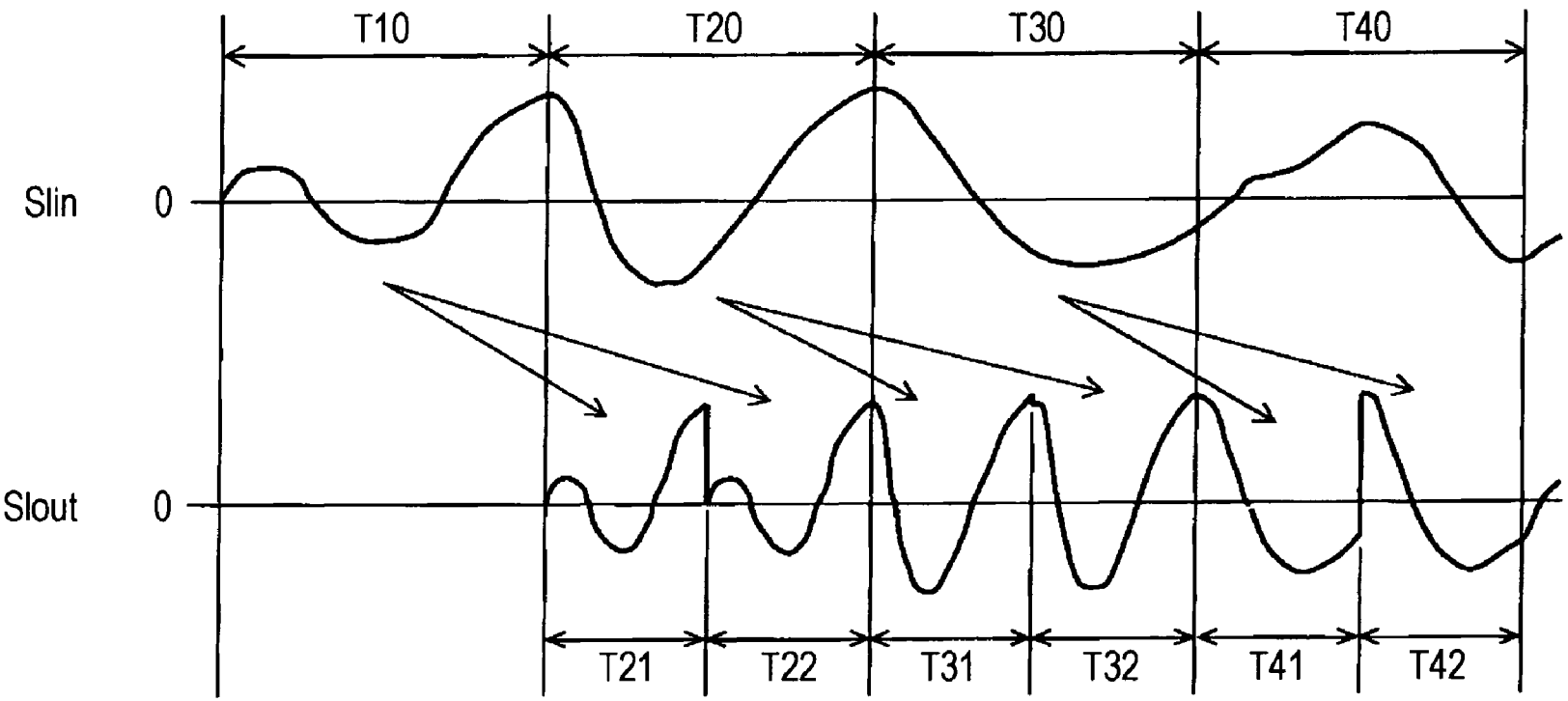
FIG. 11 is a diagram showing a harmonic-overtone generation method of the related art.

FIG. 10 shows an example of a process for determining a cycle period and a cycle pattern in the fourth example shown in FIGS. 8 and 9.

In the example shown in FIG. 10, first, in step 51, it is determined for each cycle whether or not a zero-crossing point has been detected before M samples are counted from the start point of the cycle. For the first cycle, the first point of the low-frequency component Slin (which may or may not be a zero-crossing point) is set as the start point of the cycle. For each of the second and following cycles, the end point of the previous cycle (which may or may not be a zero-crossing point) is set as the start point of the cycle.

If a zero-crossing point has been detected before M samples are counted from the start point of the cycle, the process proceeds from step 51 to step 52 at the time when the zero-crossing point is detected. In step 52, the period of the cycle is determined so that the detected zero-crossing point is set as the end point of the cycle. Then, in step 53, it is determined whether or not the start point of the cycle (for the first cycle, the first point of the low-frequency component Slin) is a zero-crossing point.

If the start point of the cycle is a zero-crossing point, the cycle is a period between zero-crossing points. Thus, the process proceeds from step 53 to step 54, in which it is determined that the cycle has a regular pattern. Then, in step 61, the count value j of the number of samples is reset to zero to determine the next cycle.

If the start point of the cycle is not a zero-crossing point, the cycle is a period between a non-zero-crossing point and a zero-crossing point. Thus, the process proceeds from step 53 to step 55, in which it is determined that the cycle has a rear-side irregular pattern. Then, in step 61, the count value j of the number of samples is reset to zero to determine the next cycle.

Also for the first cycle, if the start point of that cycle (the first point of the low-frequency component Slin) is a non-zero-crossing point and the end point thereof is a zero-crossing point, it is determined that the cycle has a rear-side irregular pattern. In the read operation, it is preferable that the samples be read once without being thinned out.

If it is determined in step 51 that no zero-crossing point has been detected before M samples are counted from the start point of the cycle, the process proceeds to step 56 at the time when M samples are counted from the start point of the cycle, i.e., the time when the count value j of the number of samples reaches the value M. In step 56, the period of the cycle is determined so that the time at which the count value j reaches the value M is set as the end point of the cycle. Then, in step 57, it is determined whether or not the start point of the cycle (for the first cycle, the first point of the low-frequency component Slin) is a zero-crossing point.

If the start point of the cycle is a zero-crossing point, the cycle is a period between a zero-crossing point and a non-zero-crossing point. Thus, the process proceeds from step 57 to step 58, in which it is determined that the cycle has a front-side irregular pattern. Then, in step 61, the count value j of the number of sample is reset to zero to determine the next cycle.

Also for the first cycle, if the start point of that cycle (the first point of the low-frequency component Slin) is a zero-crossing point and the end point thereof is a non-zero-crossing point, it is determined that the cycle has a front-side irregular pattern. In the read operation, it is preferable that the samples be read once without being thinned out.

If the start point of the cycle is not a zero-crossing point, the cycle is a period between non-zero-crossing points. Thus, the process proceeds from step 57 to step 59, in which it is determined that the cycle has an intermediate irregular pattern. Then, in step 61, the count value j of the number of samples is reset to zero to determine the next cycle.

Also for the first cycle, if the start point of that cycle (the first point of the low-frequency component Slin) and the end point thereof are non-zero-crossing points, it is determined that the cycle has an intermediate irregular pattern. In the read operation, it is preferable the samples be read once without being thinned out.

Therefore, in a write operation to a buffer, a cycle is determined and a cycle pattern is then determined. In steps 54, 55, 58, and 59, the write addresses of the start point and end point of the cycle, and the determined pattern of the cycle are stored in, for example, the controller 15 of the harmonic-overtone generation processing unit 10 shown in FIG. 2 for the read control described above. In a read operation from the buffer, the samples are read on the basis of the stored write addresses and pattern in the manner described above in the context of the fourth example shown in FIGS. 8 and 9.

The fourth example is a method suitable when the low-frequency component Slin has a low frequency (long wavelength), and can be used in combination with either the first example shown in FIG. 5, the second example shown in FIG. 6, or the third example shown in FIG. 7 for zero-crossing detection. For example, if the fourth example is used in combination with the third example shown in FIG. 7, $K<M<L$ is satisfied.

Other Embodiments

In the examples described above, the frequency of an original low-frequency component is multiplied by a factor of 2. In general, the frequency can be multiplied by a factor of N (where N is a positive integer more than one).

For music applications, however, if the frequency of the fundamental tone is multiplied by a factor of 2, a tone one octave higher than the fundamental tone is obtained. Therefore, it is preferable that N be a power of 2, i.e., N =2, 4, 8, 16, etc.

In some cases, low-frequency components having a considerably low frequency may be recorded in compact discs (CDs), Super Audio CDs (SACDs), or the like. When the impression of low-frequency sounds is generated from such low-frequency components, other harmonic-overtone signals as well as second-harmonic-overtone signals, such as fourth-, eighth-, and 16th-harmonic-overtone signals, can be generated using the method according to the embodiment of the present invention.

In the foregoing embodiment, the frequency of a low-frequency component having a frequency not greater than the lowest reproducible frequency f0 of the speaker is multiplied. Alternatively, the frequency of a low-frequency component of not greater than a frequency different from the lowest reproducible frequency f0 of the speaker may be multiplied according to a desired frequency for which the impression of low-frequency sounds is to be generated.

Further, in the foregoing embodiment, a low-frequency-enhanced audio signal is supplied to a speaker. Alternatively, a low-frequency-enhanced audio signal may be supplied to a headphone.

It should be understood by those skilled in the art that various modifications, combinations, sub-combinations and alterations may occur depending on design requirements and other factors insofar as they are within the scope of the appended claims or the equivalents thereof.

What is claimed is:

1. An audio processing method comprising:

writing, in a memory, at least one sample of a signal component having a first frequency less than a predetermined frequency in an input audio signal that is a digital signal having a predetermined sampling frequency; and generating a harmonic-overtone signal having a second frequency, wherein the second frequency is equal to N multiplied by a third frequency of the input audio signal, by repeating an operation N times, where N is an integer greater than or equal to one, the operation including reading one sample and thinning out (N−1) samples for every N samples of the at least one sample from the memory within a cycle period from a first one-direction zero-crossing point to a second one-direction zero-crossing point subsequent to the first one-direction zero-crossing point, wherein both first and second one-direction zero-crossing points are upward one-direction zero-crossing points at which a level of the input audio signal changes from negative to positive or both first and second one-direction zero-crossing points are downward one-direction zero-crossing points at which the level of the input audio signal changes from positive to negative.

2. The audio processing method according to claim 1, wherein the second one-direction zero-crossing point does not include a third one-direction zero-crossing point detected before a count value obtained by counting a number of samples from the first one-direction zero-crossing point reaches a predetermined value.

3. The audio processing method according to claim 1, wherein when the second one-direction zero-crossing point is not detected at a time when a count value obtained by counting a number of samples from the first one-direction zero-crossing point reaches a predetermined value, the cycle period comprises a period from the first one-direction zero-crossing point to the time when the count value reaches the predetermined value, and the samples corresponding to the period are read without being thinned out.

4. The audio processing method according to claim 3, wherein the cycle period is a first cycle period, the period is a first period, and within a second cycle period subsequent to the first cycle period that is the period from the first one-direction zero-crossing point to the time when the count value reaches the predetermined value when the second one-direction zero-crossing point is not detected at the time when the count value obtained by counting the number of samples from the first one-direction zero-crossing point reaches the predetermined value, samples corresponding to a second period from the time when the count value reaches the predetermined value to the second one-direction zero-crossing point are read without being thinned out.

5. The audio processing method according to claim 1, wherein the first and/or second one-direction zero-crossing point comprises a second point at which the level of the input audio signal has a predetermined positive value after changing from negative to positive, or a third point at which the level of the input audio signal has a predetermined negative value after changing from positive to negative.

6. The audio processing method according to claim 1, wherein the audio signal comprises a music signal; and N is a power of 2.

7. The audio processing method according to claim 1, further comprising combining the harmonic-overtone signal with a signal component having a fourth frequency greater than the predetermined frequency in the input audio signal to obtain an output audio signal.

8. The audio processing method according to claim 1, further comprising combining the harmonic-overtone signal with the input audio signal to obtain an output audio signal.

* * * * *